US009803474B1

(12) United States Patent
Tong

(10) Patent No.: US 9,803,474 B1
(45) Date of Patent: Oct. 31, 2017

(54) SYSTEMS AND METHODS FOR ALERT AND ADVISORY BROADCAST

(71) Applicant: Gar Lung Bethune Tong, Hong Kong (HK)

(72) Inventor: Gar Lung Bethune Tong, Hong Kong (HK)

( * ) Notice: Subject to any disclaimer, the term of this patent is extended or adjusted under 35 U.S.C. 154(b) by 0 days.

(21) Appl. No.: 15/296,107

(22) Filed: Oct. 18, 2016

(51) Int. Cl.
*G01V 3/00* (2006.01)
*E21B 47/12* (2012.01)

(52) U.S. Cl.
CPC ..... *E21B 47/122* (2013.01)

(58) Field of Classification Search
CPC ..... E21B 47/122
See application file for complete search history.

(56) References Cited

U.S. PATENT DOCUMENTS 5,942,987 A * 8/1999 Heinrich ..... G06K 7/0008 340/10.42
2003/0162504 A1* 8/2003 Sabongi ..... H04W 24/00 455/67.11
2005/0035781 A1* 2/2005 Chen ..... H03K 19/17756 326/38
2008/0212544 A1* 9/2008 Twitchell ..... H04Q 9/00 370/338
2010/0039986 A1* 2/2010 Jones ..... H04L 69/22 370/328
2011/0038344 A1* 2/2011 Chmiel ..... H04W 48/08 370/330

* cited by examiner

*Primary Examiner* — Erin File

(57) ABSTRACT

Methods, radios, components thereof, and other terminals for broadcasting alert and advisory. A radio signal at a current radio frequency is obtained. The current radio signal comprises a plurality of identifiers, numbers, and commands that collectively represent an advisory signal. Each receiving terminal in the plurality of receiving terminals corresponds to a portion of the broadcast area. The current radio signal is compared with a predetermined group number, a terminal number, and a physical address. Each receiving terminal in the plurality of reference receiving terminals is associated with a group number, a terminal number, and a physical address. When the comparing identifies a unique match between the current radio signal and a reference receiving terminal in the plurality of reference receiving terminals, the advisory signal is deemed to be targeted to the physical address associated with the receiving terminal.

16 Claims, 6 Drawing Sheets

SYSTEMS AND METHODS FOR ALERT AND ADVISORY BROADCAST

FIELD OF THE INVENTION

The present invention relates to a wireless radio frequency communication system for transferring commands and advisory data between receiving terminals and a station host in a well field.

BACKGROUND OF THE INVENTION

Present techniques for advisory broadcast have drawbacks that they require relatively expensive equipment and/or installations of each of the individual equipment at the end user locations. It is extremely expensive and time consuming for on-site technicians to monitor and control each individual tuner. With transportation of people and things around the world becoming increasingly easier and inexpensive, it is becoming more necessary to build smart terminals that are able to automatically detect and adjust to the changing environment. The software that tailors the tuner to a particular tuner region involves setting up the operational frequency range, the frequency step between adjacent frequencies, and other predefined variables to ensure proper operation. This is applicable in the industrial process of natural gas drilling, producing hazardous substances during the development that results in contamination of the site and its surrounding area. Development of gas wells may even require releases of methane and myriad toxic gases into the atmosphere. All greenhouse gas emissions, including methane, the main component in natural gas, can be traced to oil, gas and coal extracted. For the benefit of environment and residents nearby, an advisory broadcasting system is desired for broadcasting alert and advisory in a cost-effective manner, reaching a large coverage rapidly by using a wireless radio frequency system.

SUMMARY OF THE INVENTION

The present invention addresses the shortcomings found in the prior art. Embodiments of the present invention as disclosed collect live productivity data and streaming advisory information broadcast from remote sites of interest (such as oil and gas drilling locations, construction sites, etc.) in real-time into a collection and distribution network that delivers this data and information via radio signals. According to the invention, a method for broadcasting alert and advisory from a plurality of geographically spaced receiving terminals and radio station hosts in oil or gas producing well fields, comprising the steps of gathering data relating to at least one of the spaced oil or gas producing wells; and broadcasting radio signals to receiving terminals sweeping at a current radio frequency that corresponds to the same frequency of the broadcast. According to the invention, the broadcasting radio signals include identifiers, initialization commands, physical addresses, at least one terminal number, at least one group number, and at least one dedicated frequency. According to the invention, the method of the invention is carried out on terminals that are geographically spaced in the field. The spacing of terminals can vary over a wide range but typically will be in the range of % to 1 mile. In the method, a current radio signature is obtained. This current radio signature comprises a plurality of measured signal qualities that collectively represent a frequency spectrum. Each measured signal quality in the plurality of measured signal qualities corresponds to a portion of the frequency spectrum. The current radio signature is compared to a plurality of reference radio signatures. Each reference radio signature in the plurality of reference radio signatures is associated with a global position. When the comparing identifies a unique match between the current radio signature and a reference radio signature in the plurality of reference radio signatures, the receiving terminal is deemed to be localized to the global position associated with the reference radio signature.

Radio waves are used for transmission of the data along the paths to an internet provider station. For this type of radio waves, the terminals are typically spaced less than 1 mile apart. Thus, in a preferred embodiment of the invention, the well hoping step includes wireless transmission of the gathered data between the geographically spaced terminals. In the practice of the invention, each of the receiving terminals is assigned a unique address and a dedicated frequency. Typically, each well is assigned a preferred frequency and one or more alternative frequencies in the event that no signal is being received at the current dedicated frequency. According to the invention, any of the frequencies can be automatically changed at the receiving terminals.

The invention further relates to a method for communicating between wells and a remote location comprising the steps of sending from a station host to a receiving terminal an advisory data packet intended for a destination receiving terminal, transferring the advisory data packet from the station host to a first receiving terminal via radio waves, determining if the first receiving terminal is the destination receiving terminal, if the first receiving terminal is the destination receiving terminal, broadcasting the contained advisory verbiage, wherein the advisory verbiage is part of the advisory signal, or discarding the advisory signal if a mismatch of group number is determined.

Another aspect of the invention provides a terminal comprising radio signatures. Each reference radio signature in the plurality of reference radio signatures is associated with a global position. The terminal further comprises a radio signature measurement model for localizing a geographic position of a terminal. The radio signature measurement model comprises instructions for obtaining a current radio signature. The current radio signature comprises a plurality of measured signal qualities. Each measured signal quality in the plurality of measured signal qualities corresponds to a portion of the frequency spectrum. The terminal further comprises a radio signature comparison module having instructions for comparing the current radio signature to the plurality of reference radio signatures.

Another aspect of the invention comprises a plurality of reference radio signatures. Each reference radio signature in the plurality of reference radio signatures is associated with a global position. The radio further comprises means for localizing a geographic position of the radio. The radio signature measurement model further comprises instructions for obtaining a current radio signature. This current radio signature comprises a plurality of measured signal qualities that collectively represent a frequency spectrum. Each measured signal quality in the plurality of measured signal qualities corresponds to a portion of the frequency spectrum. The radio further comprises means for comparing the current radio signature to the plurality of reference radio signatures.

DETAILED DESCRIPTION OF THE INVENTION

The present invention provides cost effective systems and methods for broadcasting alerts and advisory to receiving terminals geographically spaced in the field. In the present invention, radio signal reception is polled across a spectrum of frequencies. These measurements are collectively termed a radio signature. The group number contained in a radio signature is then compared to a plurality of reference group number in a receiving terminal. Each reference group number corresponds to a known location. For example, a first reference group number in the plurality of radio advisory signals corresponds to a first location and a second reference group number in the plurality of radio advisory signals corresponds to a second location. Direction can be obtained as the receiving terminal moves across boundaries between locations with different reference group numbers.

Figure 1:
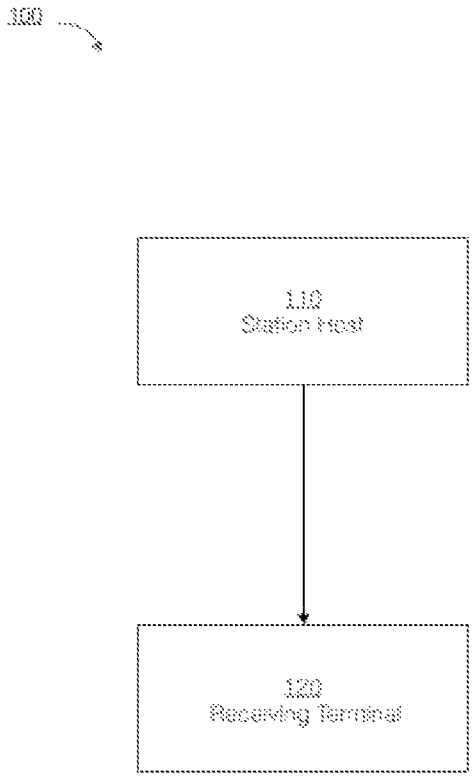
FIG. 1 illustrates a radio advisory system comprising a station host and a receiving terminal.

Reference will now be made to FIG. 1, which shows an exemplary receiving terminal 120 in accordance with an embodiment of the present invention. Many aspects of receiving terminal 120 are conventional and will not be discussed so that the inventive aspects of the present invention can be emphasized. In typical embodiments, receiving terminal 120 includes a radio signal decoder. In preferred embodiments, radio signal decoder can be controlled by a microprocessor to scan a predetermined range of frequencies in order to measure signal strength across the range of frequencies. In general, any type of microarchitecture that can store or access from memory approximately one megabyte of data and has about one megaflop or greater of computing power is suitable for implementing preferred embodiments of the present invention. Memory includes software modules and data structures that are used by microprocessor to implement the present invention. In some embodiments, memory stores past radio frequencies in addition to the current radio frequency. Past radio frequencies can be used in the methods of the present invention to establish the current radio frequency. Memory further comprises a radio signature comparison module for comparing the current measured radio signature (and possibly past measured radio signatures) to reference radio signatures, determining reception of radio signals at a last saved current radio frequency, and waiting for an advisory signal at the last saved current radio frequency if reception of radio signals is determined at the last saved current radio frequency. The module further determines reception of radio signals at the dedicated frequency if the last saved current radio frequency is determined to determine to have no reception of radio signals. It waits at the dedicated frequency for the advisory signal if reception of radio signals at the dedicated frequency is determined, and performs sweeping if no reception of radio signals is determined at the last saved current radio frequency and at the dedicated frequency.

In typical embodiments, radio signal decoder serves as an auxiliary radio tuner that function as the 'background' tuner within receiving terminal 120, scanning all available frequencies and allowing for continuous reception of data from information systems such as Radio Data System. The user to the desired radio frequency tunes the primary radio tuner while the auxiliary radio tuner is used to perform sweeps in accordance with the present invention and obtain information from sources such as the Radio Data System. Microprocessor can be a component of radio signal decoder or a standalone component. In some embodiments, the functionality of radio signal decoder and/or microprocessor is embedded in one or more application specific integrated circuits and/or field-programmable gate arrays. In some embodiments, microprocessor is implemented as one or more digital signal processors. Receiving terminal 120 includes a display for displaying the data feed and/or navigational information provided by the present invention.

The memory further comprises a radio display module for displaying information as a function of geographic position. For example, consider the case in which radio signature comparison module determines that radio is in geographic position one. In such instances, radio display module will display information on display associated with geographic position one. Then, when radio signature comparison module determines that radio is in geographic position two, module will display information on display associated with geographic position two. Further, the memory comprises an update module for updating radio signatures and global position specific information. Update module typically receives updates to such signatures from radio signals decoded by radio signal decoder. Such updates are typically incremental in fashion. For example, if the radio signature for a specific geographic location has changed because a radio station host has gone online (or offline), a data feed in the radio signal decoded by radio signal decoder transmits the updated radio signature and update module updates memory accordingly.

In addition to the above-identified software modules, the memory comprises a plurality of radio signatures. Each radio signature corresponds to a predetermined global position. In preferred embodiments, each radio signature corresponds to a geo-polygon that represents a region with a distinct FM signature that has been generated by analyzing overlapping station host broadcast regions. Each radio signature includes a plurality of frequency windows and, for each such frequency window, a signal quality. In typical embodiments, frequency windows are used to circumvent the effects of phenomenon such as spectral leakage that occurs at frequencies close to those of certain station hosts. Tuning a radio to the next possible FM channel and discerning the sounds of an adjacent FM channel can observe such spectral leakage. Here, the term spectral leakage is used loosely because it has not been determined whether or not such effects are due to station host properties or to receiver properties. That is, it is possible that tuner specific hardware limitations cause this apparent problem. Radio signatures can be referred to as reference radio signatures, and signal qualities can be referred to as reference signal qualities.

In some embodiments, only the maximum value within a given frequency window is considered the signal quality of the window. The size of each frequency window is chosen to reflect the typical separation between active station host frequencies so that true signal peaks are not removed from the signature. Thus, in some embodiments, each frequency window represents a predetermined range of frequencies and the signal quality corresponding to the frequency window represents the strongest observable signal in the range of frequencies. In some embodiments, each frequency window in radio signature is uniform. That is, each frequency window has the same spectral width. In other embodiments, there is no requirement that each frequency window in radio signature have uniform spectral width. In preferred embodiments, the plurality of frequency windows in a given radio signature define a contiguous spectral region. In some embodiments, the plurality of frequency windows in a given radio signature define two non-contiguous spectral regions. In preferred embodiments, each radio signature has the same frequency windows as radio signature and optional radio signatures, thereby facilitating direct comparison of radio signatures. In preferred embodiments, each frequency window uniquely represents a particular frequency spectrum. In less preferred embodiments, there is overlap in the frequency windows of a radio signature. In some embodiments, there are between five and ten thousand frequency windows in a radio signature. In more preferred embodiments, there are between ten and five hundred frequency windows in a radio signature. In still more preferred embodiments there are between and frequency windows in a radio signature.

Signal quality is any measure of signal quality. Non-Limiting examples of signal quality includes a decibel rating and a voltage. In some embodiments, signal quality is represented in binary form where a first binary value represents a signal quality greater than some predetermined threshold value and a second binary value represents a signal quality that is less than some predetermined threshold value. In some embodiments, each radio signature corresponds to a unique global position in any combination of countries in the world.

In some embodiments, there are more than one radio signatures corresponding to the same unique global position. Certain embodiments include more than one radio signature for a given global position to account for different conditions.

Moreover, some terminals that can serve as radio signal decoder and microprocessor can measure additional variables that are useful for establishing a metric that represents signal quality in a given frequency window. Thus, in some embodiments, signal quality actually consists of measurements for several different variables. In some embodiments, each of these variables are combined to form a single representation of signal quality for a given frequency window. In other embodiments, each of these variables independently serves as a unique representation of signal quality. In such embodiments, signal quality for a given frequency window is multidimensional.

In some embodiments, radio signature comparison module determines the global position of radio at a given point in time and radio display module displays this global position on display. In some optional embodiments, radio display module uses the newly determined global position to see if there is any information for the position. If radio display module finds a match between the newly identified global position and a record, then module displays record on display. In some embodiments, record provides traffic or weather information for the global position corresponding to record. In some embodiments, record provides a detailed street map for the global position corresponding to record. Such updates can include, for example, updated traffic information and/or updated weather information for specific global positions.

Figure 2:
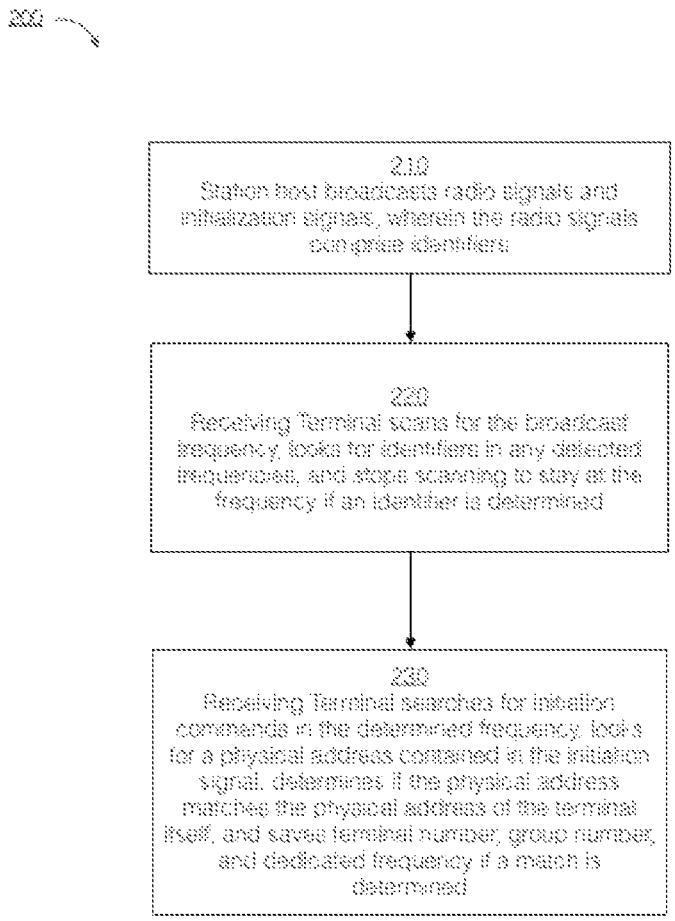
FIG. 2 is a flowchart illustrating the process of a receiving terminal executing initialization process upon powering on for the first time.

Now that an overview of a receiving terminal 120 in accordance with one embodiment of the present invention has been described with reference to FIG. 1, a method of using the receiving terminal 120 to identify the global position of the receiving terminal in accordance with one embodiment will be described in conjunction with FIG. 2.

In step 210, a determination is made of a current radio frequency. This is accomplished by scanning a predetermined range of frequencies. The present invention envisions a broad spectrum of different possible predetermined frequency ranges. However, in a preferred embodiment, the predetermined range of frequencies is the FM band. Scanning starts at a last saved current radio frequency for a radio signal broadcasted from a station host, and if no reception of radio signals detected at the last saved frequency, then starts scanning at the dedicated frequency instead. The predetermined range of frequencies is divided into a plurality of predetermined frequency windows that collectively represent the predetermined range of frequencies. If reception of radio signals is detected at the dedicated frequency, and if an identifier is detected in the radio signals, then stays at the frequency to wait for reception of advisory signals 220; otherwise, start sweeping for radio signals across a frequency window in the predetermined range of frequencies. The receiving terminal searches for initialization commands contained in an initialization signal, to look for a physical address. If the terminals own address matches to the physical address contained in the initialization signal, then the receiving terminal saves the terminal number, group number, and dedicated frequency contained in the signal 230. For each frequency window in the predetermined range of frequencies, a signal quality is measured and saved as the corresponding signal quality for the frequency window. In some embodiments, this signal quality represents the maximum field/signal strength measured in the frequency window. For example, in some embodiments, radio signal decoder is a generic programmable radio module that reports FM signal quality as an analog value within a voltage range. In some embodiments, metrics in addition to or instead of FM signal quality are used to assess a given frequency window. For example, in some embodiments an FM multipath signal is measured in addition to FM signal quality. In some embodiments a quality is measured in addition to FM signal quality. For those variables that vary as a function of frequency, the variables are recorded for each frequency window. For those variables that do not vary as a function of frequency, a signal measurement of such variables is recorded for the radio signature.

In some embodiments, for each frequency in the predetermined range of frequencies, the parameter of interest is measured several different times. For each measurement, the value assigned to the parameter of interest at the given frequency is the average, median, or mean of the individual values measured for the parameter of interest at the given frequency. In some embodiments, such measurements are performed in a sweep. For example, in some embodiments, the predetermined range of frequencies is measured in a sweep. The sweep begins at one end of the predetermined range of frequencies and finishes at the other end of the predetermined range. Measurements of the parameters needed to assess signal quality are performed at each frequency in the predetermined range of frequencies. For example, in some embodiments, the predetermined range of frequencies is the entire FM band.

In some embodiments, the period of time spent at each frequency is one second. In some embodiments, more than one parameter is measured simultaneously. In many instances, the capabilities of the radio signal decoder will dictate whether or not parameters can be concurrently sampled, which parameters can be sampled, and how frequently such parameters can be sampled. However, at a minimal level, a parameter that is indicative of signal strength is measured at each frequency or frequency window. In some embodiments, between 10 and 10,000 samples per second are taken of a parameter of interest during a sweep. In more preferred embodiments, between 100 and 5,000 samples per second are taken of a parameter of interest during a sweep.

In some embodiments, successive instances of step 210 are performed at timed intervals. For example, step 210 is performed every second, every minute, half hour, or some longer interval. When step 210 is repeated, the values for current radio signature may change subject to new measurements from radio signal decoder. In some embodiments, the current radio signature is saved as a past radio signature prior to saving new values for current radio signature. Past radio signatures may or may not have a global position assigned to them. However, in all instances past radio signatures have frequency windows that exactly correspond to frequency windows of current radio signature. Thus, to save a current radio signature as a past radio signature, signal quality values are simply mapped onto and saved to the corresponding signal quality value fields.

Close to a station host, it is often the case that the observed signal strength of the station host appears to be saturated. While not intending to be limited to any particular theory, the perceived saturation is likely due to limitations in presently available radio signal decoders. While this perceived saturation has no adverse effect on measured signature, little information about the noise characteristics of the signal can be gleaned at close distances to a station host. Thus, in some embodiments, only non-saturated values from step 210 are considered. In such embodiments, frequency windows in which a signal quality is saturated are removed from the radio signature. For example, in some embodiments, this removal process entails designating the saturated frequency window for nonuse. Frequency windows that are designated for non use are not compared to corresponding frequency windows in subsequent processing steps.

It has been observed that, for some radio signal decoders, the signal quality value never falls to the lowest possible value in the range of allowed values. In particular, it has been observed that even at frequencies at which there is no station host, a radio signal decoder outputs a basal radio signal quality voltage rather than outputting a reading of 0 volts. While not intending to be limited to any particular theory, it is believed that a DC offset in the radio signal decoder causes this basal voltage. While such receiver limitations have no known adverse effects on measured signature, they do not contribute to the global position determination. Therefore, in some embodiments, removing the offset from each signal quality measurement in radio signature normalizes the current radio signature. The purpose of such normalization is to improve the stability of subsequent comparison methods. In one embodiment, signal quality is FM quality and normalization involves the removal of an offset that appears in the FM quality signal.

In some embodiments, normalization comprises amplifying measured signal quality values to increase separation between data peaks in the radio signature. Such amplification can be accomplished by multiplying each signal quality by a constant in embodiments in which there is only a signal quality parameter measured per frequency window. While this has the effect of amplifying noise in addition to true signals, it has been found that such amplification increases the stability of the comparison method by reducing its required sensitivity.

Methods for obtaining a current radio signature have been provided. It will be appreciated that the methods by which current radio signature was obtained can be used to measure each of the radio signatures. A receiving terminal as described typically makes such measurements in the exemplary systems below and/or some other mechanism for determining global position. The receiving terminal used to make the measurements for radio signature can be the same receiving terminal used to make the measurements for radio signature. However, in more typical embodiments, different receiving terminals are used. Each radio signature can be processed to exclude saturated frequencies and to normalize to remove any form of basal voltage in the same manner in which radio signature is optionally processed.

In most instances, a comparison of the current measured radio signature to signatures is sufficient to uniquely identify the global position of receiving terminal 120. However, past radio signatures can be used to break any ties that may arise. For example, consider the case in which receiving terminal is in a car heading North along a highway. At time point one, a current radio signature is measured. Comparison of current radio signature to each radio signature identifies a clear best match. Now, at point two, current radio signature is again measured. However, comparison of current radio signature to each radio signature identifies two radio signatures that match the new current radio signature. To break the tie, the radio signature in the set of two matching radio signature that is geographically proximate to the most recent past radio signature is selected. Selection of the geographically proximate radio signature is selected on the premise that receiving terminal 120 could not have traversed too far. This example illustrates the use of a single past radio signature. However, in practice, any number of past radio signatures can be used to break ties.

In some embodiments, a brute force approach is applied in which a comparison score is generated for each such comparison. In some embodiments this comparison score is simply an indication as to whether the two signatures match. In one embodiment, a declining threshold method is used. In the declining threshold method, the frequency window with the strongest signal quality is first considered. Only those respective radio signatures that have a measured signal in the corresponding frequency window that is stronger than the measured signal in any other frequency window of the respective radio signature are considered. If this comparison does not limit the candidate signatures to a single candidate signature, then the second strongest signal in current radio signature is considered and so forth until a single candidate signature is identified. Comparison of just a single frequency in many instances is a powerful indicator of the geographical location of radio signature measurement model. Therefore, comparison of two, three or four different frequencies using the above identified declining threshold method is, in most instances, sufficient to identify a single matching radio signature.

In some embodiments, the signal strength of at least one frequency is used to assign current radio signature a global location using the systems and methods of the present invention. In more preferred embodiments, the signal strengths of two or more frequencies are used to assign current radio signature a global location. In some embodiments, between two and ten frequencies are used to assign current radio signature a global location. In some embodiments, between three and twenty frequencies are used to assign current radio signature a global location. In any of these embodiments, one or more additional signal quality parameters is optionally used to facilitate the assignment of a global location to current radio signature.

In some embodiments, rather than the declining threshold method, a "decision tree" approach is used to identify a match. In some embodiments of the "decision tree" approach, the most powerful signals in current radio signature are matched against candidate radio signatures. Then candidate radio signatures are assessed based on the likeliness that such candidates represent the correct location. For example, in cases where past radio signatures with assigned global positions are available, candidate radio signatures having global positions that are proximate to assigned global positions are given more weight than distal signatures. This process continues until a single geo-polygon target is reached with the highest probability as the solution. In some embodiments, other parameters in addition to signal strength are used in the "decision tree" approach. For example, in some embodiments, signal strength in addition to available information about signal quality is used. In fact, any combination of signal quality metrics that are stored in memory can be used.

In some embodiments, the signal quality metrics measured in the current radio signature are reduced to a searchable expression. In embodiments in which a real value is assigned, error tolerances can be added.

In some embodiments, more than one type of signal quality metric can be found in the current radio signature besides signal strength as a function of signal frequency. In general, such additional signal quality metrics can be divided into two categories: those that have been measured as a function of frequency and those in which only a single value is measured for the entire frequency spectrum under consideration. Each metric in the former class of additional signal quality metrics can be assigned an additional row in the arrays illustrated above whereas each metric in the latter class of additional signal quality metrics can simply be added as another column to the arrays described above.

The arrays described above can then be compared using any of a wide range of comparison techniques. For example, the strongest signals in current radio signature can be compared first in the declining threshold or decision tree approaches, etc. However, the representation of current radio signature in the array format shown above is meant to aid in the visualization of what data is used to identify a matching radio signature. In practice, it is not necessary to represent signal quality metrics in the array format described above in order to find matching radio signatures.

In some embodiments, enough quality metrics are used is sufficiently populated with radio signatures to ensure that receiving terminal 120 is localized to a specific global position. For example, in some embodiments, radio signatures are organized into a tree in which parent nodes representing certain radio signatures point to daughter nodes representing radio signatures that are geographically proximate to the signatures represented by parent nodes and/or have a signature that is similar to the signatures represented by parent nodes.

A global position is assigned to receiving terminal 120 based on the respective radio signature that best matches current radio signature. In cases where a plurality of candidate radio signatures are found rather than a unique match, previously measured radio signatures can be used to identify the appropriate radio signature among the candidates.

In some embodiments, consider the case in which global position is geographic position. Radio display module optionally displays all or a portion of the contents of the corresponding record on display. In some embodiments information includes information not only for display but also audible information, such as an alarm, a sound, an audible message, audible instructions, a song, etc. In such instances, the audible information is sounded using the amplification system of receiving terminal 120.

In some embodiments, information is updated by update module on a regular or irregular basis using information received by radio signal decoder. For example, in some embodiments radio signal decoder receives a Radio Data System or high definition signal that carries geographic specific traffic, weather, or general news updates. Update module parses this information into appropriate records. Then, this information is displayed on display and/or audibly sounded.

Figure 3:
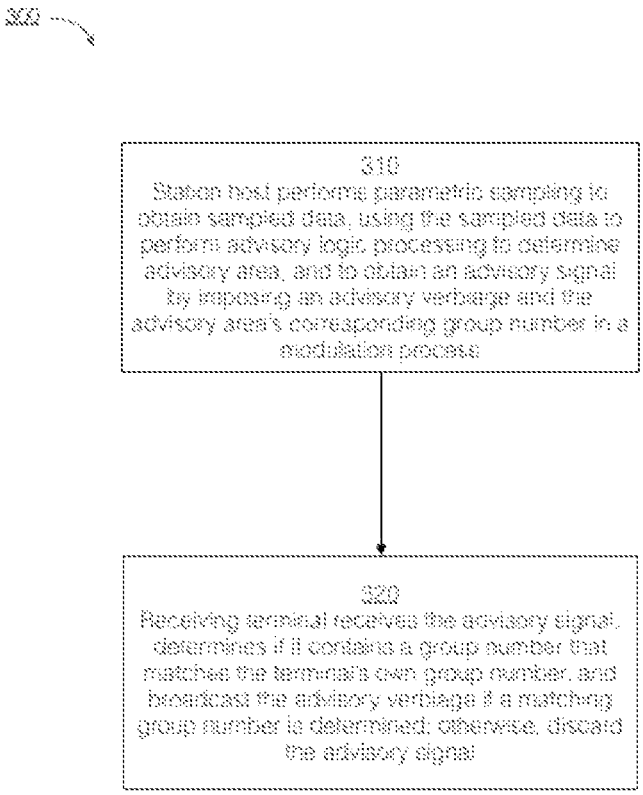
FIG. 3 is a flowchart illustrating the process of an advisory processing procedure with an embodiment of the present invention.

Referring to FIG. 3, step 310 is reached if a unique radio signature has been identified as matching current radio signature. In such instances, parametric sampling is used to obtain parametric sample data. The parametric sampled data will be used to determine an advisory area by performing an advisory analysis with the parametric sample data, and then imposing an advisory verbiage and the advisory area's group number in a modulation process to obtain an advisory signal 310. Step 320 is reached when a receiving terminal receives the advisory signal. A determination is made as to whether the advisory signal is targeted for the area where the terminal is located in. The terminal compares its own group number to that contained in the advisory signal for the determination. In some embodiments, the geographic positions assigned to past radio signatures are used to help eliminate candidate radio signatures. For instance, if there are two candidate radio signatures remaining and one of the two signatures is proximate to the geographic positions assigned to past radio signatures and the other is not, the proximate signature is selected and the other signature is eliminated. Once an advisory signal is determined to have a matching group number, the terminal broadcasts the advisory verbiage contained in the signal; otherwise, the terminal discard the advisory signal.

Another important observation that can be made is that, regardless of the correspondence between station host locations and city boundaries, there are relatively low upper bounds on the number of station hosts for each frequency. A declining threshold method can be used with either a model or a model, as not all sources of error can be accounted for in either model. This illustrates the point that the declining threshold method of comparison only considers peak data. Only the global FM floor is removed in order to produce this normalization. A better method of normalization, such as a windowing method, would be more useful for differentiating between strong signals and signal peaks. Several sources of noise affect the FM signature sensed by a receiver. While this has no ill effect on the FM signature at these locations, very little information about the noise characteristics of the signal can be gleaned at these distances. This illustrates the importance of a correlation between the resulting geo polygons generated with a model and the sensed signals using receiver hardware. This reaffirms the utility of a simple comparison methods, such as the declining threshold, whereby the location of the receiver is determined using only the most prevalent data trends. This phenomenon significantly aids in the determination of location and direction, as the method of comparison can use weaker signal peaks to resolve the receiver location within a parent region defined by stronger signal peaks. If signal reception terminated suddenly, such granularity would not be obtainable.

Figure 4:
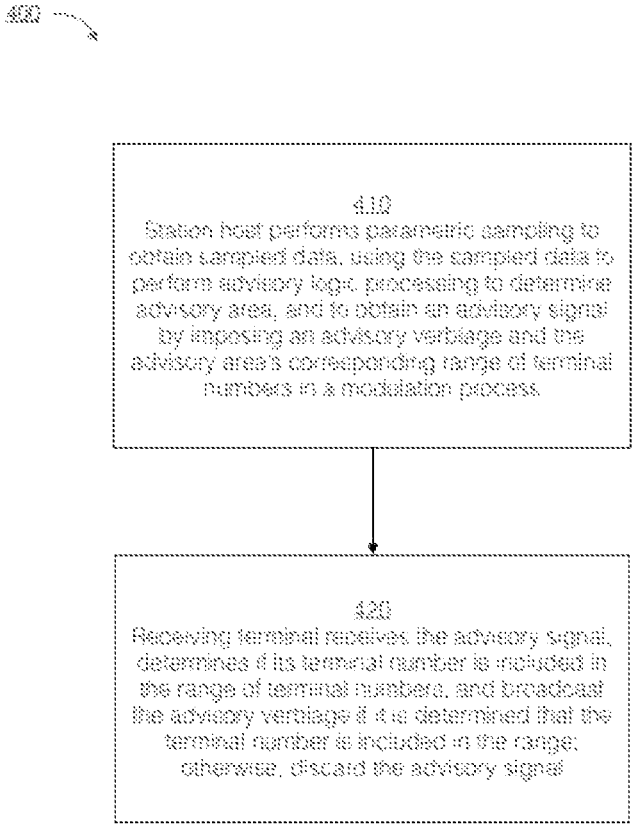
FIG. 4 is a flowchart illustrating the process of an advisory processing procedure with another embodiment of the present invention.

Referring to FIG. 4, step 410 is reached if a unique radio signature has been identified as matching current radio signature. In such instances, parametric sampling is used to obtain parametric sample data. The parametric sampled data will be used to determine an advisory's coverage area by performing an advisory analysis with the parametric sample data, and then imposing an advisory verbiage and advisory's coverage area in a modulation process to obtain an advisory signal 410. Step 420 is reached when a receiving terminal receives the advisory signal. A determination is made as to whether the terminal's number is included within the advisory's range of terminal numbers. The terminal compares its own terminal number to the range contained in the advisory signal for the determination. In some embodiments, the geographic positions assigned to past radio signatures are used to help eliminate candidate radio signatures. Once an advisory signal is determined to be within range, the terminal broadcasts the advisory verbiage contained in the signal; otherwise, the terminal discard the advisory signal.

Some receiver-dependent characteristics also affect the sensed FM signature. In particular, the signal floor resulting from hardware limitations or from ambient noise in the FM band can significantly affect the form of the FM signature. The un-normalized signature suggests signal reception from a wide variety of FM channels for which there are no station hosts present. Using the declining threshold method, only the peaks of the signature are important defining characteristics. This local normalization emphasizes the defining peaks as relative values to all other frequencies. Building a database of signature-based regions from an incomplete list of station hosts would result in an incomplete or inaccurate database. Another important observation relevant to signal calibration is the presence of spectral leakage for frequencies close to those of certain station hosts. The occurrence of an FM signature with two adjacent FM peaks is usually representative of spectral leakage (easily observed by tuning the radio to the next possible FM channel and being able to make out the sounds of the adjacent FM channel). That is, it is possible that hardware limitations on the FM tuner cause this apparent problem. In some embodiments, this phenomenon is taken into consideration in the method of comparison, so that signatures with and without adjacent signals are considered for matching with known signatures.

Figure 5:
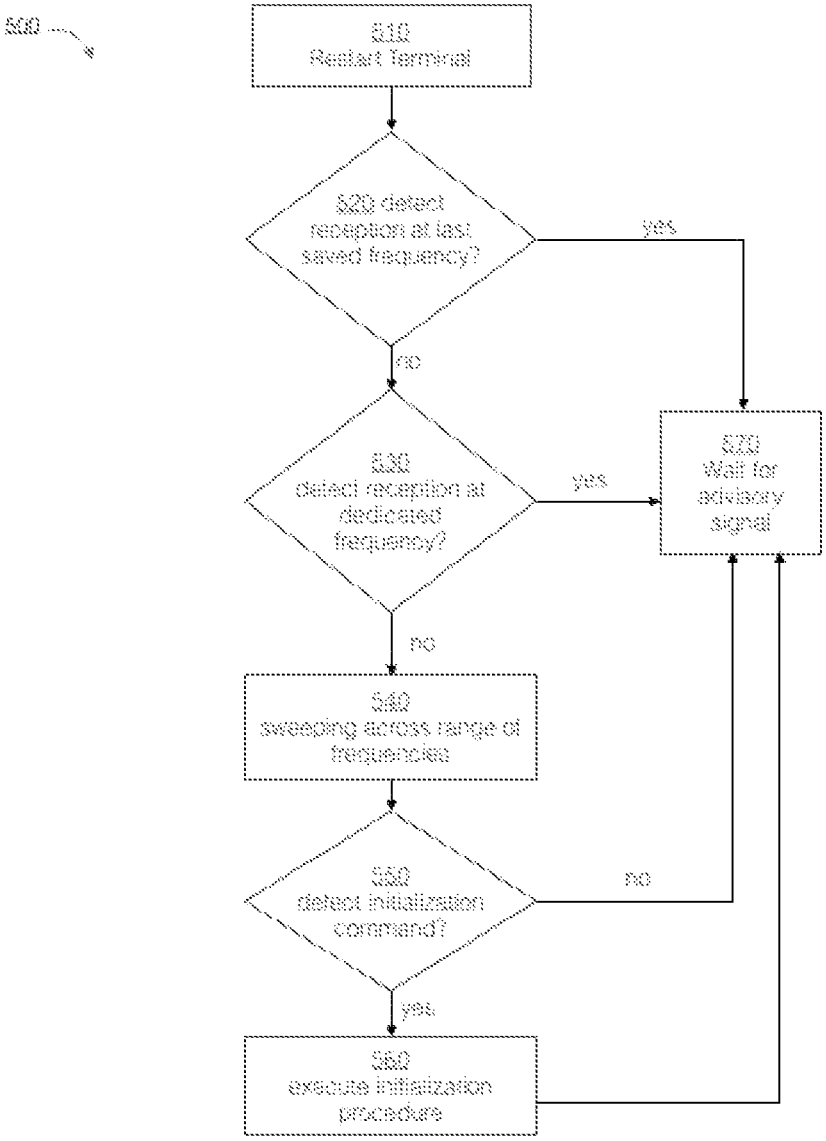
FIG. 5 is a flowchart illustrating the process of a receiving terminal executing initialization process upon powering on subsequently after the first time.
Figure 6:
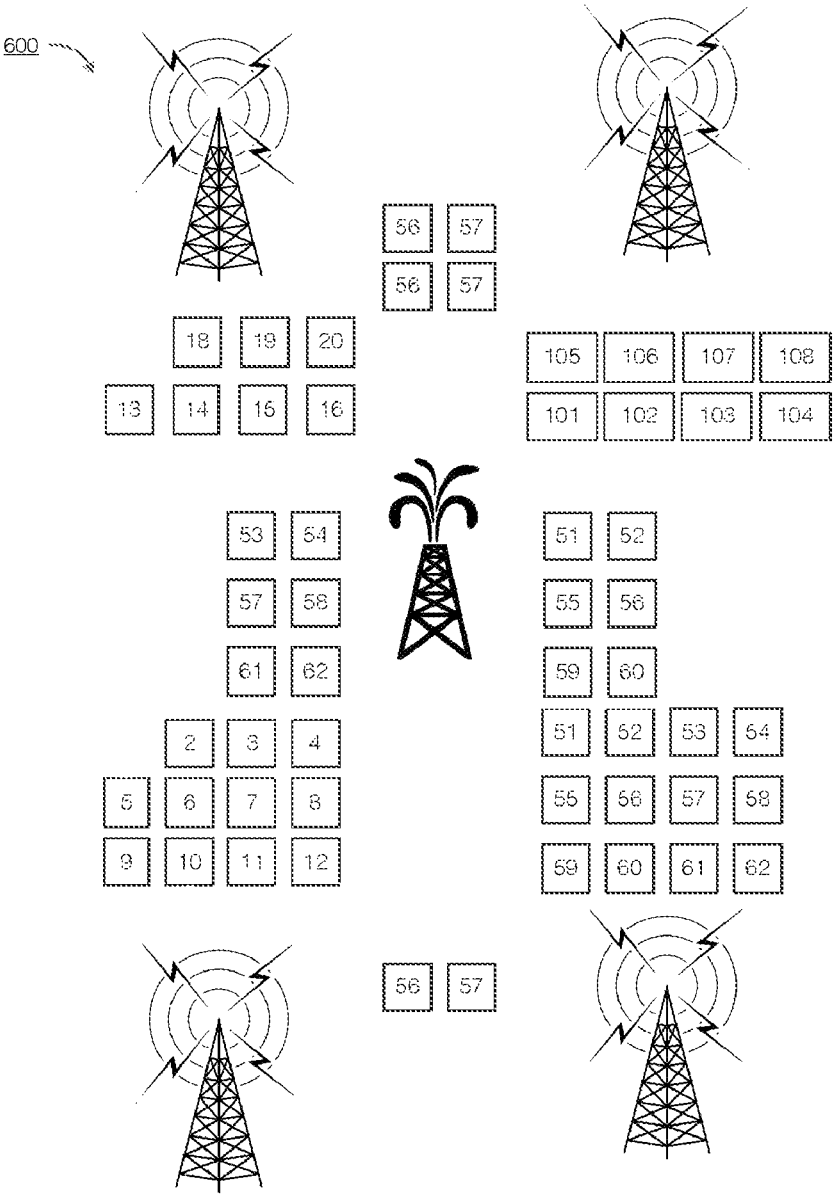
FIG. 6 illustrates a schematic representation of a well field and a station host in which an advisory signal is passed between the station host and the receiving terminals in the well field using the systems and methods of FIGS. 1-5.

Referring to FIG. 5. In preferred embodiments, a receiving terminal starts scanning for radio signals at the last saved frequency, and immediately waits for broadcast of advisory signals if reception of radio signals can be determined at the last saved frequency 570. Alternatively, if no reception can be determined at the last saved frequency, then the terminal starts determining reception of radio signals at the predetermined dedicated frequency of the terminal itself 530. The various sources of noise are accounted in order to improve the accuracy of the comparisons that are made. Sources of noise include receiver limitations and variations; atmospheric; multipath due to fixed objects; multipath due to moving objects; and station host limitations and variations. Wherever possible, noise should be taken into consideration in the development of the radio signatures so that computation is minimized in the receiver. Only fixed sources of noise can be accounted for in this manner. Receiver limitations will vary from receiver to receiver, and so must be taken into account locally. Preferably, a method of sensing that removes this error should be used before signal processing is done so that one method of comparison can be used for all receivers. At step 540, the terminal starts sweeping for radio signals across a frequency window in the predetermined range of frequencies. The terminal determines inclusion of the radio signature in the reception of any radio signals, and it stops sweeping to tune into the current radio frequency when the inclusion of the radio signature is determined. Next, at step 550, the terminal determines if the received radio signal at step 540 contains an initialization signal and a corresponding initialization command, and if so, the terminal executes an initialization procedure accordingly 560. If no initialization signals can be determined, then the terminal will skip initialization and go on to wait for reception of an advisory signal 570. It is extremely difficult to distinguish between noise due to station host variations, antennae limitations, and weather variations in a live environment. For sample data that isn't saturated due to receiver limitations, the noise displays two main trends. Higher order noise, most likely corresponding to local clutter, station host variations, varying antenna gain characteristics, and local weather conditions. Lower frequency noise can also be observed, and is more obvious at distances further from the station hosts. This suggests that the lower frequency noise corresponds to more prevalent sources of error such as terrain effects.

It is desirable to reduce the noise associated with receiver limitations before signal processing or comparison is done, so that the same algorithm can be used for all receivers. It was also noted that there appeared to be a signal floor, most likely corresponding to a DC offset in the tuner module. While these receiver limitations have no real ill effect on the FM signature at a particular location, very little information about the noise characteristics of the signal can be gleaned in these ranges. Normalizing the data with receiver specific configuration values provides a receiver-independent data set that can then be analyzed. This data set was then amplified as part of the normalization process to increase the separation between data peaks. This was done to improve the quality of the signal processing. It should be noted that, while this amplification also served to exaggerate the effect of noise in the signature, it most likely increased the stability of the comparison method by reducing its required sensitivity.

Only signal peaks are used in signature comparison in preferred embodiments of the present invention. For example, in the experiments described above, a simple windowing method was used to remove the apparent "spectral leakage", and to isolate the true signal peaks. As this processing must be done in real time, in-vehicle, the simplest possible windowing method was used. For a particular window size, only consider the maximum value within the window. The size of the window is chosen to reflect the typical separation between active FM station host frequencies so that the true signal peaks are not removed from the signature.

A declining threshold method can be used with a model, as not all sources of error can be accounted for in either model. The declining threshold method also has the advantage of simplicity, requiring minimal computation by effectively ignoring all but the most pertinent data. This method also provides for various levels of granularity, with very coarse predictions given almost instantly, and a more refined prediction, until an exact match is found. With the use of a model that determines what the Electromagnetic Field strength should be at particular locations, a simple method of comparison could be used that is, more or less, independent of the particular unit of measure used. The declining threshold method is useful in this respect, as it can serve to compare to similar, but not identical, entities.

Signals degrade gradually with distance as opposed to sudden loss of reception. This will significantly aid in the determination of location and direction, as the method of comparison will use weaker signal peaks to resolve the receiver location within the parent region determined using stronger signal peaks. While a direct binary comparison might return the same signature for two similar regions, the declining threshold method will provide the order in which individual signals should be considered, thereby differentiating between two similar regions with slightly different signal strengths.

It is not entirely clear how well models account for the sources of noise. While the signatures at the exact recorded locations reflect the actual signature that will be received at that particular location, the signatures received within the same region, but not at that particular location, may not be identical. All received signatures in that area will not be identical. Two ways to avoid this problem with an model include: reducing the grid size to improve accuracy, or using averages values in a region to determine a single representative FM signature. Reducing the grid size could yield extremely accurate results, but with significant cost in terms of development and maintenance. Using averaged values makes the inclusion of noise in the model less clear. What sort of processing would be required on a receiver to match such an averaged reference signature is, as yet, unknown.

Ideally, a model that includes specific sources of noise accurately, and other sources of noise not at all, would provide for a robust system of comparison in which the receiver is responsible for filtering out only particular sources of noise. A model with a very small grid size would be ideal for such a system, but very impractical to implement.

A model that takes into account the effects of terrain and fixed clutter is suitable. This leaves the receiver with the following sources of noise to filter out: receiver limitations, atmospheric and station host variations, and moving objects. In addition to helping minimize the effects of receiver limitations, using time-averaged values can also help to reduce the error associated with moving objects. Thus, a model that can account for terrain and fixed clutter effects is a preferred in some embodiments of the present invention.

The invention claimed is:

1. An alert and advisory broadcast system, wherein a radio signal is being broadcasted at a first frequency, and a plurality of receiving terminals are sweeping at a current radio frequency that corresponds to the first frequency, the system comprising:

a station host, wherein the station host is adapted to broadcast a radio signal, the radio signal comprises an identifier and an initialization signal, the initialization signal further comprises an initialization command, a physical address; at least one terminal number, at least one group number, and at least one dedicated frequency; and a receiving terminal, wherein the receiving terminal is adapted to:

sweep for reception of the radio signal by scanning a range of frequencies for the station host's broadcasting frequency, determine inclusion of the initialization signal in the radio signal, and execute an initialization procedure if the radio signal is determined to include the initialization signal; wherein the receiving terminal stops sweeping to tune into the current radio frequency when the inclusion of the radio signature is determined, and the initialization procedure determines matching the physical address with the receiving terminal's location, saving the at least one terminal number, the at least one group number, and the at least one dedicated frequency when a match is determined between the physical address and the location of the receiving terminal.

2. The system of claim 1, wherein the station host is further adapted to broadcast an advisory signal that includes an advisory verbiage and a group number; and the receiving terminal further adapted to:

determine a match of group number between the advisory signal and the receiving terminal;

broadcast the advisory verbiage if a match of group number is determined; and discard the advisory signal if a mismatch of group number is determined.

3. The system of claim 1, wherein the station host is, further adapted to broadcast an advisory signal that includes an advisory verbiage and a broadcast area, and the receiving terminal is further adapted to:

determine if the receiving terminal has a terminal number that belongs in the broadcast area;

broadcast the advisory verbiage if the terminal number is determined to belong in the broadcast area; and discard the advisory signal if the terminal number is determined to not belong in the broadcast area.

4. The system of claim 2, wherein the advisory signal is generated by an advisory data processing procedure; the procedure comprises:

parametric sampling to obtain parametric sample data;

determining an advisory area by performing advisory analysis with the parametric sample data; and imposing an advisory verbiage and the advisory area's group number in a modulation process to obtain the advisory signal.

5. The system of claim 3, wherein the advisory signal is generated by an advisory data processing procedure, the procedure comprises:

parametric sampling to obtain parametric sample data;

determine an advisory area by performing advisory analysis with the parametric sample data to; and imposing an advisory verbiage with the advisory area's broadcast area in a modulation process to obtain the advisory signal.

6. The system of claim 4, wherein the parametric sampling comprises atmospheric pressure parametric sampling, temperature parametric sampling, and wind speed parametric sampling.

7. The system of claim 5, wherein the receiving terminal is further adapted to:

determine reception of radio signals at a last saved current radio frequency;

wait for an advisory signal at the last saved current radio frequency if reception of radio signals is determined at the last saved current radio frequency;

determine reception of radio signals at the dedicated frequency if the last saved current radio frequency is determined to have no reception of radio signals;

wait at the dedicated frequency for the advisory signal if reception of radio signals at the dedicated frequency is determined; and perform the sweeping if no reception of radio signals is determined at the last saved current radio frequency and at the dedicated frequency.

8. The system of claim 1, wherein the receiving terminal may be an AM or FM receiving terminal.

9. A method for broadcasting alert and advisory to a receiving terminal with a station host, wherein the station host comprises a broadcasting of a radio signal at a first frequency, and the receiving terminal is sweeping at a current radio frequency that corresponds to the first frequency, the method comprising:

broadcasting of a radio signal, the radio signal comprises an identifier and an initialization signal, the initialization signal further comprises an initialization command, a physical address, at least one terminal number, at least one group number, and at least one dedicated frequency;

sweeping for reception of the radio signal, wherein the sweeping scans a range of frequencies for the station host's broadcasting frequency, determines inclusion of the radio signature in the radio signal, stops sweeping to tune into the current radio frequency when the inclusion of the radio signature is determined;

determining inclusion of the initialization signal in the radio signal; and executing an initialization procedure if the radio signal is determined to include the initialization signal, wherein the initialization procedure determines matching the physical address with the receiving terminal's location, saving the at least one terminal number, the at least one group number, and the at least one dedicated frequency when a match is determined between the physical address and the location of the receiving terminal.

10. The method of claim 9, further comprises:

broadcasting of an advisory signal that includes an advisory verbiage and a group number;

determining a match of group number between the advisory signal and the receiving terminal;

broadcasting the advisory verbiage if a match of group number is determined; and discarding the advisory signal if a mismatch of group number is determined.

11. The method of claim 9, further comprises:

broadcasting of an advisory signal that includes an advisory verbiage and a broadcast area;

determining if the receiving terminal has a terminal number that belongs in the broadcast area;

broadcasting the advisory verbiage if the terminal number is determined to belong in the broadcast area; and discarding the advisory signal if the terminal number is determined to not belong in the broadcast area.

12. The method of claim 10, wherein the advisory signal is generated by an advisory data processing procedure, the procedure comprises:

parametric sampling to obtain parametric sample data;

determining an advisory area by performing advisory analysis with the parametric sample data; and imposing an advisory verbiage and the advisory area's group number in a modulation process to obtain the advisory signal.

13. The method of claim 11, wherein the advisory signal is generated by an advisory data processing procedure, the procedure comprises:

parametric sampling to obtain parametric sample data;

determine an advisory area by performing advisory analysis with the parametric sample data to; and imposing an advisory verbiage with the advisory area's broadcast area in a modulation process to obtain the advisory signal.

14. The method of claim 12, wherein the parametric sampling comprises atmospheric pressure parametric sampling, temperature parametric sampling, and wind speed parametric sampling.

15. The method of claim 13 further comprises:

determining reception of radio signals at a last saved current radio frequency;

waiting for an advisory signal at the last saved current radio frequency if reception of radio signals is determined at the last saved current radio frequency;

determining reception of radio signals at the dedicated frequency if the last saved current radio frequency is determined to determined to have no reception of radio signals;

waiting at the dedicated frequency for the advisory signal if reception of radio signals at the dedicated frequency is determined; and performing the sweeping if no reception of radio signals is determined at the last saved current radio frequency and at the dedicated frequency.

16. The method of claim 9, wherein the receiving terminal may be an AM or FM receiving terminal.

* * * * *